US008100498B2

(12) United States Patent
Picciotto et al.

(10) Patent No.: US 8,100,498 B2
(45) Date of Patent: Jan. 24, 2012

(54) METHODS AND SYSTEMS FOR PROVIDING PRINT MEDIA DISTORTION COMPENSATION

(75) Inventors: Carl E. Picciotto, Menlo Park, CA (US); Jun Gao, Saratoga, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 847 days.

(21) Appl. No.: 11/860,507

(22) Filed: Sep. 24, 2007

(65) Prior Publication Data

US 2009/0079780 A1 Mar. 26, 2009

(51) Int. Cl.
*B41J 29/393* (2006.01)

(52) U.S. Cl. ..... 347/19; 347/14

(58) Field of Classification Search ..... 347/19, 347/14

See application file for complete search history.

(56) References Cited

U.S. PATENT DOCUMENTS

| | | | | |
|---|---|---|---|---|
| 6,027,020 | A * | 2/2000 | Meyer-Wittreck et al. | 235/381 |
| 6,556,273 | B1 * | 4/2003 | Wheeler et al. | 352/92 |
| 2002/0033869 | A1 * | 3/2002 | Kurabayashi et al. | 347/100 |
| 2003/0021437 | A1 * | 1/2003 | Hersch et al. | 382/100 |
| 2003/0057280 | A1 * | 3/2003 | Mandile | 235/454 |
| 2005/0071040 | A1 * | 3/2005 | Kirila, II | 700/130 |
| 2006/0170934 | A1 | 8/2006 | Picciotto et al. | |
| 2007/0024664 | A1 * | 2/2007 | Shang et al. | 347/19 |

* cited by examiner

*Primary Examiner* — Laura Martin

(57) ABSTRACT

A reference image of an area of a print media is captured at approximately a first time by an image acquisition system. A first application of ink is applied onto the print media area by a printing assembly at the first time. A comparison image of the print media area is captured at a second time by the image acquisition system subsequent to the first application of ink onto the print media area. The reference image and the comparison image are processed to determine a relative displacement of a feature pattern on the print media between approximately the first time and the second time. A second application of ink from the printing assembly onto the print media is adjusted based on the determination.

23 Claims, 5 Drawing Sheets

METHODS AND SYSTEMS FOR PROVIDING PRINT MEDIA DISTORTION COMPENSATION

CROSS-REFERENCE TO RELATED APPLICATIONS

The subject matter of this patent specification relates at least in part to the subject matter of U.S. patent application Ser. No. 10/995,837, filed Nov. 23, 2004, and U.S. patent application Ser. No. 10/995,840, also filed Nov. 23, 2004, each of which is incorporated by reference herein.

FIELD

The present invention generally relates printer systems and more particularly to methods and systems for providing print media distortion compensation during a multi-pass printing process.

BACKGROUND

Many types of printers perform multiple printing passes over print media during the printing process. The print media is typically patterned with an ink pattern during each printing pass. In some cases, a new ink pattern is imprinted onto the same area of the print media that was previously imprinted upon during a prior printing pass. In some cases, a new ink pattern is imprinted onto an area of the print media immediately adjacent a print media area that was previously imprinted upon during a previous printing pass.

Some forms of print media often undergo distortion upon exposure to the moisture present in many printer inks. Examples of such print media distortion include, but are not limited to, expansion, cockling, and rippling. Other causes of print media distortion, expansion, cockling, and rippling include, but are not limited to, mechanical stresses such as for example stretching, twisting, binding, and thermal stresses. Print media distortion can lead to the misalignment of ink patterns imprinted onto the print media during the multiple printing passes.

Some prior art solutions seek to restrict print media distortion by securing the print media in place during a multi-pass printing process. Examples of print media securing mechanisms include tension based mechanisms and vacuum hold-down mechanisms. While such prior art solutions often reduce some forms of distortion, such as for example, expansion, in many cases, the print media releases stress induced by exposure to printer ink moisture in other forms of distortion, such as for example cockling or rippling. Furthermore, print media restriction mechanisms typically cannot be employed in situations where the printing assembly is maintained in a generally fixed position and the print media is moved with respect to the printing assembly during the multi-pass printing process.

SUMMARY

According to one aspect of the invention, a reference image of an area of a print media is captured at approximately a first time by an image acquisition system. A first application of ink is applied onto the print media area by a printing assembly at the first time. A comparison image of the print media area is captured at a second time by the image acquisition system subsequent to the first application of ink onto the print media area. The reference image and the comparison image are processed to determine a relative displacement of a feature pattern on the print media between approximately the first time and the second time. A second application of ink from the printing assembly onto the print media is adjusted based on the determination.

DETAILED DESCRIPTION

Figure 1:
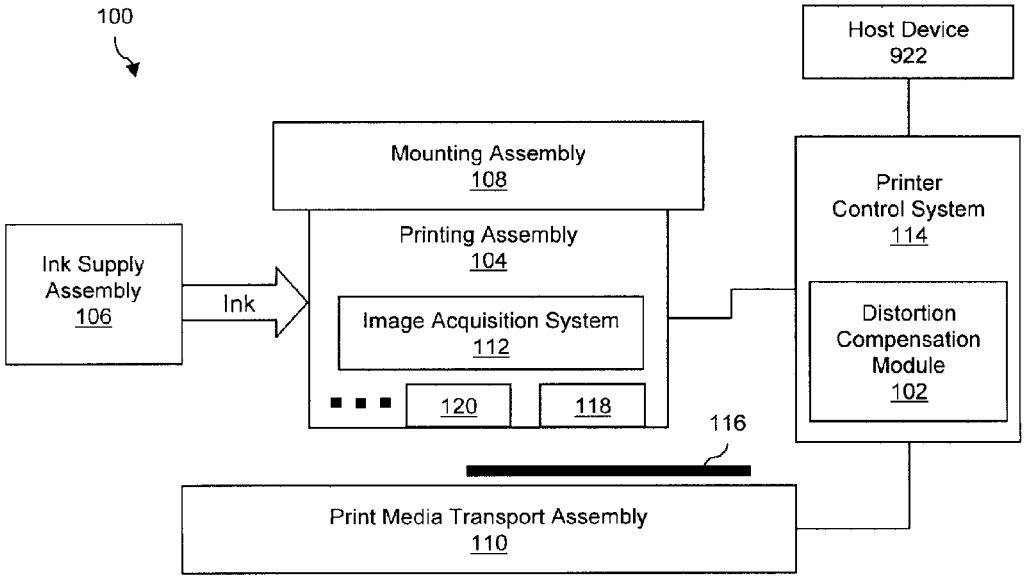
FIG. 1 is a block diagram representation of one embodiment of an inkjet printing system that provides print media distortion compensation.

Referring to FIG. 1, a block diagram representation of one embodiment of an inkjet printing system 100 that provides print media distortion compensation is shown. In other words, the inkjet printing system 100 includes apparatus for determining distortion or a dimensional change in a surface of a print media substrate or print media 116. While an inkjet printing system equipped to provide print media distortion compensation is described, alternative types of printing systems, including for example liquid electrophotographic printer systems, equipped to provide print media distortion compensation are also considered to be within the scope of the invention.

The inkjet printing system 100 generally includes a printing assembly 104, an ink supply assembly 106, a mounting assembly 108, a print media transport assembly 110, an image acquisition system 112, and a printer control system 114. In one embodiment, the printing assembly 104 includes a plurality of printheads. Each of the printheads includes a plurality of nozzles. The nozzles are typically arranged in one or more columns or arrays such that the properly sequenced ejection of ink from the nozzles causes characters, symbols, and/or other graphics or images to be printed upon a print media 116 as the printing assembly 102 and the print media 116 are moved relative to each other. In one embodiment, the printing assembly 104 includes a plurality of printhead banks 118, 120 where each of the printhead banks 118, 120 includes a plurality of printheads.

The print media transport assembly 110 generally positions the print media 116 with respect to the printing assembly 104. Responsive to a detected dimensional change or distortion of the print media 116, the inkjet printing system 100 generally adjusts the application of an ink pattern during a printing pass to align the application of the ink pattern with a previously applied ink pattern.

In one embodiment, specific printheads are typically fired in a particular sequence to create a desired ink pattern onto the print media 116. In one embodiment, upon the detection of a dimensional change in the print media 116, adjustments are made in the specific set of printheads fired to create the ink pattern in an attempt to align the newly applied ink pattern with a previously applied ink pattern. The firing of specific printheads are typically timed to create a desired ink pattern onto the print media 116. In one embodiment, the timing of the firing of individual printheads are adjusted during the course of a printing pass to compensate for detected dimensional changes in the print media 116.

In one embodiment, specific nozzles are typically fired in a particular sequence to create a desired ink pattern onto the print media 116. In one embodiment, upon the detection of a dimensional change in the print media 116, adjustments are made in the specific set of nozzles fired to create the ink pattern in an attempt to align the newly applied ink pattern with a previously applied ink pattern. The firing of specific nozzles are typically timed to create a desired ink pattern onto the print media 116. In one embodiment, the timing of the firing of individual nozzles are adjusted during the course of a printing pass to compensate for detected dimensional changes in the print media 116.

In one embodiment, the positions of individual printhead banks 118, 120 are individually adjustable within the printing assembly 104. In one embodiment, the positions of individual printhead banks 118, 120 are adjusted to compensate for detected dimensional changes in the print media 116 so that ink is applied to a proper area of the print media 116 to minimize mis-registrations between printing passes. In one embodiment, the positions of individual printheads are individually adjustable within a printing assembly 104. In one embodiment, the positions of individual printheads are adjusted to compensate for detected dimensional changes in the print media 116 so that ink is applied to a proper area of the print media 116 to minimize mis-registrations between printing passes.

While a number of different mechanisms and methods have been described for adjusting the application of an ink pattern during a printing pass to align the application of the ink pattern with a previously applied ink pattern responsive to a detected distortion of the print media 116, alternative mechanisms and methods for adjusting the application of an ink pattern responsive to the detected distortion of the print media 116 may be used.

The ink supply assembly 106 supplies ink to the printing assembly 104. In one embodiment, the printing assembly 104 and the ink supply assembly 106 are housed together to form an inkjet cartridge. In one embodiment, the ink supply assembly 106 is separate from the printing assembly 104 and the ink supply assembly 106 supplies ink to printing assembly 104 through an interface connection, such as for example, a supply tube.

The mounting assembly 108 supports the printing assembly 104 relative to print media transport assembly 110. The print media transport assembly 110 generally positions the print media 116 relative to the printing assembly 104. In one embodiment, the printing assembly 104 is a non-scanning or fixed printing assembly. The mounting assembly 108 generally fixes the printing assembly 104 at a prescribed location relative to the print media transport assembly 110 and the print media transport assembly 110 advances or positions the print media 116 relative to the printing assembly 104.

The image acquisition system 112 captures images of selected areas of the print media 116 as the printing assembly 104 and the print media 116 are moved relative to each other. The image acquisition system 112 captures one or more reference images of a specific print media area at a first time t1 and one or more comparison images of approximately the same print media area at a second time t2. The distortion compensation module 102 processes the one or more reference images and the one or more comparison images of the print media area to characterize dimensional changes of the print media 116 that have occurred between the first time t1 and the second time t2.

In one embodiment, the first time t1 is prior to the application of ink onto the print media 116 during a printing pass. In one embodiment, the first time t1 is at approximately the same time that ink is applied onto the print media 116 during a printing pass. In one embodiment, the first time t1 is immediately following the application of ink onto the print media 116 during a printing pass. The second time t2 is subsequent to the application of ink onto the print media during the printing pass. In one embodiment the second time t2 is prior to the application of ink during the next consecutive printing pass. The next consecutive application of ink by the printing assembly 104 onto the print media 116 is adjusted based on the determined dimensional changes to minimize mis-registrations between consecutive printing passes.

The image acquisition system 112 generally comprises any suitable optical or non-optical system. Examples of optical image acquisition systems include, but are not limited to, one or more cameras or other devices configured to optically capture images of selected areas of the print media 116. Examples of non-optical image acquisition systems include, but are not limited to, electron beam devices or other devices configured to capture images of selected areas of the print media 116. In one embodiment, the image acquisition system 112 is integrated into the printing assembly 104. In one embodiment, the image acquisition system 112 is separate from the printing assembly 104. In one embodiment, the image acquisition system 112 has a pixel level resolution. In one embodiment, the image acquisition system 112 has sub-pixel level resolution. Alternative embodiments of the image acquisition system 112 have alternative levels of resolution.

The printer control system 114 is communicatively coupled to one or more host systems 122 and receives print jobs from the one or more host systems 122. The printer control system 114 generally controls the operation of the inkjet printing system 100. In one embodiment, the printer control system 114 is communicatively coupled to and controls the operation of the printing assembly 104, the print media transport assembly 110, and the image acquisition system 112. The printer control system 114 controls the selection of printheads and nozzles and the timing of the ejection of ink drops from selected printheads and nozzles to create a pattern of ejected ink drops in accordance with the characters, symbols, and/or other graphics or images defined in a received print job.

In one embodiment, the printer control system 114 adjusts the selection of printheads to compensate for detected distortions in the print media 116. In one embodiment, the printer control system 114 adjusts the selection of nozzles to compensate for detected distortions in the print media 116. In one embodiment, the printer control system 114 adjusts the timing of the firing of the selected printheads to compensate for detected distortions in the print media 116. In one embodiment, the printer control system 114 adjusts the timing of the firing of the selected nozzles to compensate for detected distortions in the print media 116. In one embodiment, the printer control system 114 adjusts the positions of the printheads to compensate for detected distortions in the print media 116.

In one embodiment, the printer control system 114 controls the operation of the print media transport assembly 110 thereby controlling the positioning of the print media 116 with respect to the printing assembly 104. In one embodiment, the printer control system 112 issues commands to the image acquisition system 112 to capture images of selected areas of the print media 116 and receives the captured images for processing by the distortion compensation module 102.

In one embodiment, the distortion compensation module 102 is integrated as part of the printer control system 114. In one embodiment, the distortion compensation module 102 is separate from the printer control system 114 and communicatively coupled to the printer control system 114. The distortion compensation module 102 generally processes the reference images of the print media 116 that have been captured by the image acquisition system 112 at the first time t1 and the comparison images of the print media 116 that have been captured by the image acquisition system 112 at the second time t2 to characterize dimensional changes to the print media 116 that have occurred between the first time t1 and the second time t2. The printer control system 114 issues the appropriate commands to adjust the application of ink by the printing assembly 104 onto the print media to compensate for the detected distortion in the print media 116.

Different types of print media 116 can be used such as for example including, but not limited to, sheet material print media and continuous form or continuous web print media. Examples of sheet material print media include, but are not limited to, paper, cardstock, transparencies, Mylar, and cloth. Continuous form or continuous web print media typically includes a plurality of continuous print media sections. Examples of one type of continuous form print media include, but are not limited to, individual sheets, forms, and labels that are physically separable from each other by cutting or tearing along, for example, perforated lines. Examples of another type of continuous print media include a continuous roll of unprinted paper with individual print media sections delineated by indicia, openings, or other markings. It should be noted that while a number of different types of print media 116 that may be used with the printer systems have described, other forms of print media may also be used.

Figure 2:
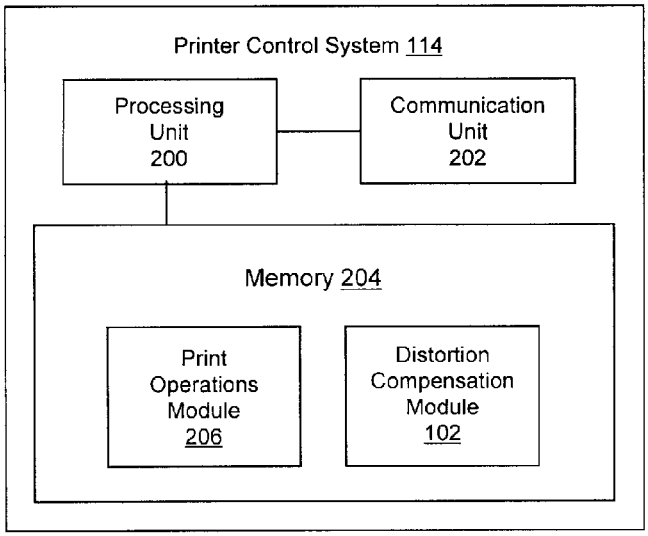
FIG. 2 is a block diagram representation of one embodiment of a printer control system.

Referring to FIG. 2, one embodiment of a printer control system 114 is shown. The printer control system 114 generally includes a processing unit 200 communicatively coupled to a communication unit 202 and a memory 204. The processing unit 200 generally includes a processor or controller. The communication unit 202 generally coordinates the exchange of data between the printer control system 114 and the printing assembly 104, the print media transport assembly 110, the image acquisition system 112, and the host device 122.

In one embodiment, the memory 204 includes one or more of a non-volatile memory, a volatile memory, and/or one or more storage devices. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, and flash memory devices. The processing unit 200 generally retrieves and executes machine readable instructions or software programs that are stored in the memory 204.

In one embodiment, the print operations module 206 and the distortion compensation module 102 are stored in the memory 204. The distortion compensation module 102 generally processes the reference images and the comparison images captured by the image acquisition system 112 to characterize distortion of the print media 116 between consecutive printing passes. The print operations module 206 generally manages the inkjet printing system 100 printing operations including, but not limited to, controlling the operation of the print media transport assembly 110 and the printing assembly 104. While the printer control system 114 has been described as including a number of different units and modules, alternative embodiments of the printer control system 114 may include additional units and/or modules that facilitate the performance of the inkjet printer system 100 functions.

Figure 3:
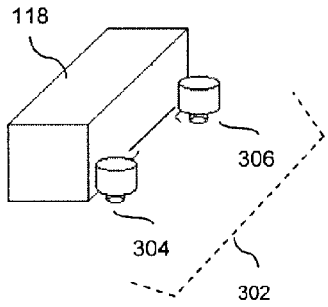
FIG. 3 is a block diagram representation of a camera cluster of one embodiment of an image acquisition system integrated with a printhead bank of a printing assembly.

Referring to FIG. 3, a block diagram representation of a camera cluster 302 of an image acquisition system 112 integrated with a printhead bank 118 of a printing assembly 104 is shown. In one embodiment, the image acquisition system 112 includes a plurality of camera clusters 302 and the printer assembly 104 includes a plurality of printhead banks 118, 120. In one embodiment, a camera cluster 302 is coupled to each printhead bank 118 such that the camera cluster 302 affixed to a specific printhead bank 118 captures images of the area of the print media 116 positioned below that printhead bank 118 to receive the ink drops ejected by that printhead bank 118. In one embodiment, each camera cluster 302 includes three cameras 304, 306. In alternative embodiments, a camera cluster may include a fewer number or a greater number of cameras.

In one embodiment, a camera cluster 302 is coupled to every printhead bank in the printing assembly 104. In one embodiment, camera clusters 302 are coupled to a number of selected printhead banks in the printing assembly 104. While an image acquisition system 112 including one configuration of cameras has been described above, alternative embodiments may include alternative configurations of cameras operable to capture images of areas of print media 116 positioned to receive ink from one or more printhead banks 118, 120. Furthermore, while in the described embodiment, the cameras 304, 306 are described as being affixed to a printhead bank 118, 120, in alternative embodiments, the cameras may be positioned with respect to printhead banks 118, 120 without actually being coupled to the printhead banks 118, 120.

In one embodiment, the image acquisition system 112 includes a single imaging device with a field of view that is capable of acquiring both the reference images at the time t1 and the comparison images at the time t2. In one embodiment, a single camera is mounted on a servomechanism that adjusts the point direction of the lens to capture the reference images at the time t1 and the comparison images at the time t2. In one embodiment, a single camera is used to capture large overall images of the print media 116 at the first time t1 and the second time t2. The reference images and the comparison images are extracted from portions of the overall images. While a number of different image acquisition systems 112 have been described, alternative embodiments may include alternative forms of image acquistions systems that operate to capture one or more reference images and comparisons images.

Figure 4:
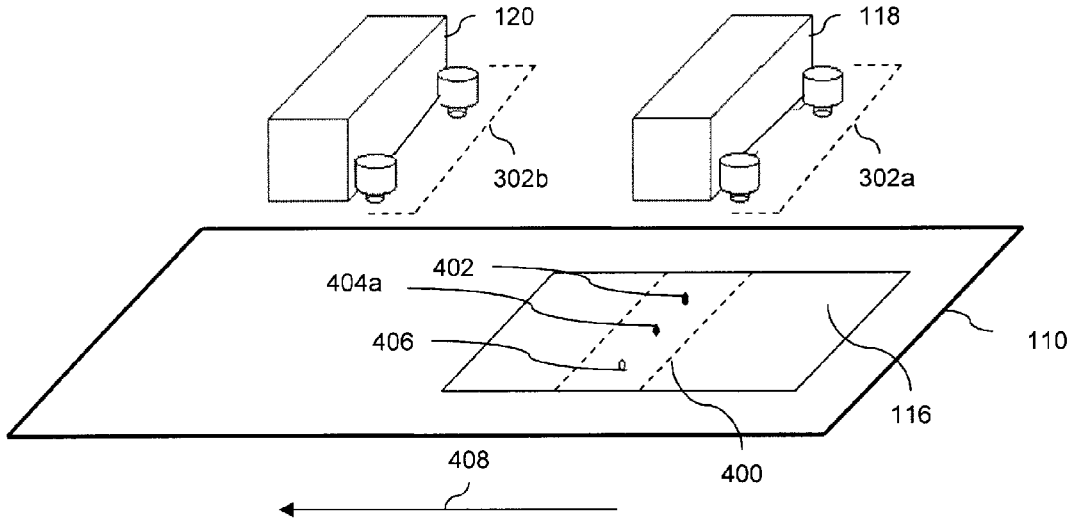
FIG. 4 illustrates a print media positioned relative to a first printhead bank of one embodiment of an inkjet printing system immediately following the application of ink onto the print media by the first printhead bank.

Referring to FIG. 4 an illustration of a print media 116 positioned relative to a first printhead bank 118 of one embodiment of an inkjet printing system 100 immediately following the application of ink onto the print media 116 by the first printhead bank 118 is shown. The print media 116 is positioned on the print transport assembly 110 with respect to the first printhead bank 118 such that the ejection of ink from the first printhead bank 118 has created a pattern of three ink marks 402, 404 and 406 on the print media area 400. The ink drop 404 is positioned at a point 404*a* of the print media 116. The arrow 408 indicates the direction of movement of the print media 116 by the print media transport assembly 110.

A first camera cluster 302*a* is coupled to the first printhead bank 118. In one embodiment, the first camera cluster 302*a* captures the one or more images of the print media area 400 following the positioning of the print media area 400 with respect to the first printhead bank 118. In one embodiment, the cameral cluster 302*a* captures the one or more images of the print media area 400 prior to the application of ink from the first printhead bank 118 onto the print media area 400. In one embodiment, the cameral cluster 302*a* captures the one or more images of the print media area 400 approximately simultaneously with the application of ink from the first printhead bank 118 onto the print media area 400. In one embodiment, the cameral cluster 302*a* captures the one or more images of the print media area 400 immediately following the application of ink from the first printhead bank 118 onto the print media area 400.

The images of the print media area 400 captured by the first camera cluster 302*a* are used as reference images by the distortion compensation module 102 to characterize the dimensional changes to the print media 116 resulting from the application of ink by the first printhead bank 118. The set of one or more reference images are captured prior to the occurrence of dimensional changes of the print media 116 resulting from the application of ink onto the print media area 400 by the first printhead bank 118. The same images of the print media area 400 are also used as comparison images by the distortion compensation module 102 to characterize dimensional changes that have occurred to the print media 116 resulting from the application of ink to the print media 116 during the previous printing pass.

Figure 5:
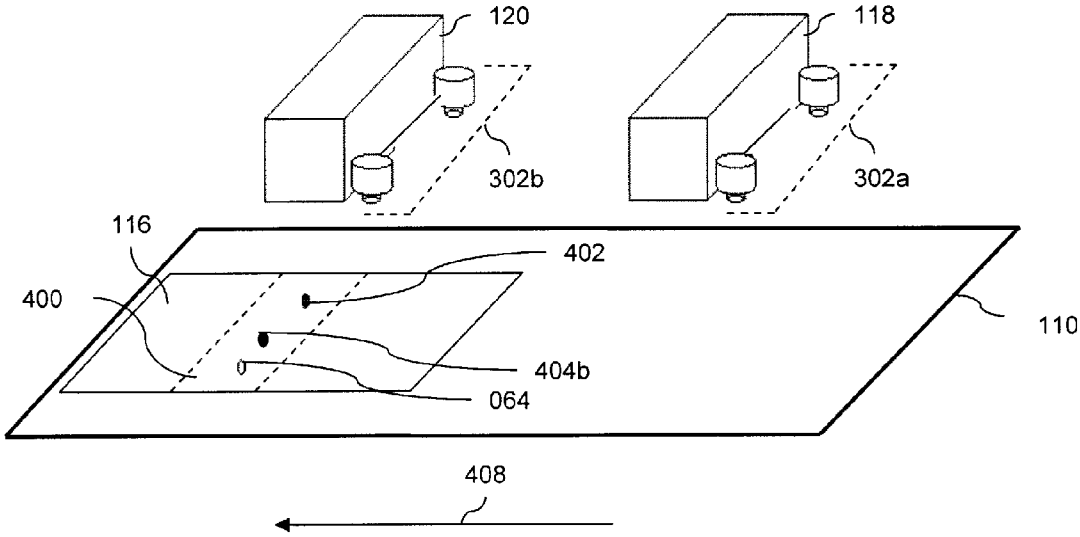
FIG. 5 illustrates a print media positioned relative to the second printhead bank of one embodiment of an inkjet printing system prior to the application of an ink pattern onto the print media by the second printhead bank.

Referring to FIG. 5, an illustration of the print media 116 positioned relative to the second printhead bank 120 of one embodiment of an inkjet printing system 100 prior to the application of an ink pattern onto the print media 116 by the second printhead bank 120 is shown. The print media 116 is positioned on the print transport assembly 110 with respect to the second printhead bank 120 such that the ejection of ink from the second printhead bank 120 will form a pattern in the print media area 400. The arrow 408 indicates the direction of movement of the print media 116 by the print media transport assembly 110.

A second camera cluster 302*b* is coupled to the second printhead bank 120. In one embodiment, the second camera cluster 302*b* captures the one or more images of the print media area 400 following the positioning of the print media area 400 with respect to the second printhead bank 120 and prior to the application of ink from the second printhead bank 120 onto the print media area 400.

The images of the print media area 400 captured by the second camera cluster 302*b* prior to the application of ink onto the print media 116 by the second printhead bank 120 are used as comparison images by the distortion compensation module 102 to characterize dimensional changes that have occurred to the print media 116 resulting from the application of ink to the print media 116 by the first printhead bank 118 during the previous printing pass. An example of a dimensional change of the print media 116 is illustrated by the relative displacement of an ink mark 1204 from a first position 404*a* of the print media area 400 to a second position 404*b* of the print media area 400. The distortion or dimensional change occurred following the application of ink onto the print media area 400 by the first printhead bank 118 during the previous printing pass and prior to the application of ink onto the print media 116 by the second printhead bank 120 during the current printing pass.

The same images of the print media area 400 that have been captured by the second camera cluster 302*b* prior to the application of ink onto the print media 116 by the second printhead bank 120 are used as reference images by the distortion compensation module 102 to characterize the dimensional changes to the print media 116 that occur during the time interval following the application of ink by the second printhead bank 120 and prior to the application of ink by the next printhead bank during the next consecutive printing pass.

Figure 6:
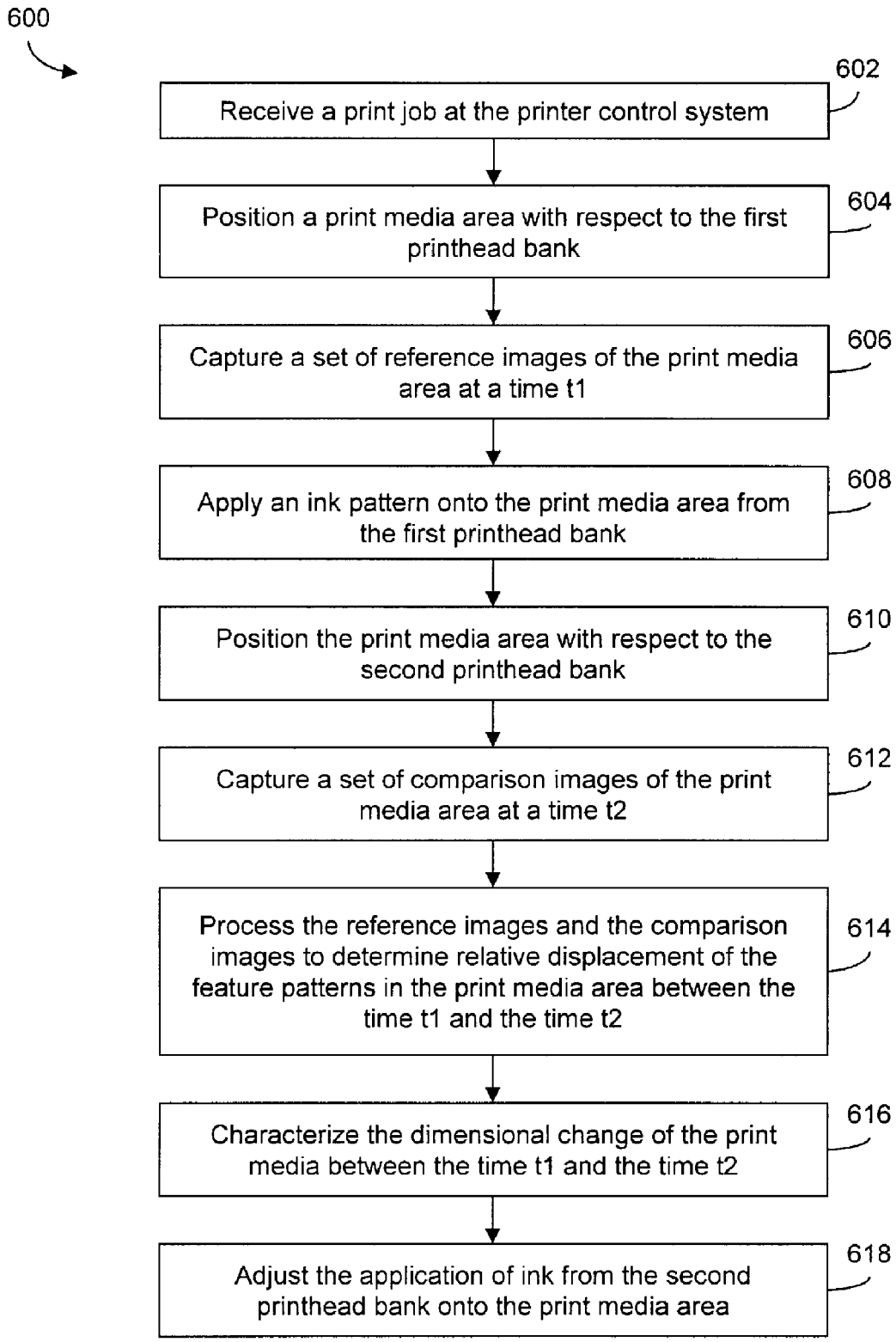
FIG. 6 is a flowchart representation of one embodiment of a method of compensating for print media distortion.

Referring to FIG. 6, a flowchart representation of one embodiment of a method 600 of compensating for print media distortion is shown. The printer control system 114 receives a print job from a host device 122 at step 602. The print job includes the data to be printed on the print media 116. At step 604, the print media transport assembly 110 positions the print media 116 at a first position relative to the printing assembly 104 such that the ejection of ink from the first printhead bank 118 creates an ink pattern onto the print media area 400.

At step 606, the first camera cluster 302*a* captures a set of one or more reference images of the print media area 400 at the time t1. More specifically, the first camera cluster 302*a* captures the set of one or more reference images of the print media area 400 following the positioning of the print media area 400 with respect to the first printhead bank 118. The set of one or more reference images are captured prior to the occurrence of dimensional changes of the print media 116 resulting from the application of ink onto the print media area 400 by the first printhead bank 118.

Figure 7:
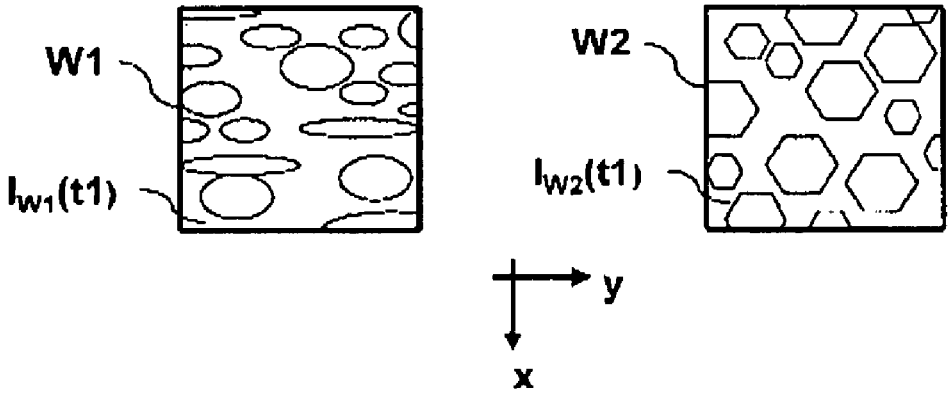
FIG. 7 illustrates an example of reference images acquired by the image acquisition system at a first time prior to a dimensional change of the print media.

Referring to FIG. 7, an illustration of an example of reference images acquired by the image acquisition system at a first time prior to a dimensional change of the print media 116 is shown. A first reference image $I_{W1}(t1)$ is captured in the first window W1 at time t1, and a second reference image $I_{W2}(t1)$ is captured in the second window W2 at time t1. The first and second reference images $I_{W1}(t1)$, $I_{W2}(t1)$ are captured by the first and second cameras, respectively, in the first camera cluster 302*a*. In one embodiment, the first and second reference images $I_{W1}(t1)$, $I_{W2}(t1)$ within the first and second windows W1, W1 define first and second reference feature patterns, respectively. In one embodiment, the sub-areas of the first and second reference images $I_{W1}(t1)$, $I_{W2}(t1)$ within the first and second windows W1, W1 define first and second reference feature patterns, respectively.

Preferably, the windows W1 and W2 are relatively small compared to an overall dimension of the print media 116. More particularly, each window should be small enough such that any dimensional changes taking place over the spatial extent of the window itself have a small or negligible effect on the operation of an image displacement sensing algorithm performed on the captured images within a required precision. Stated another way, each window should be small enough such that the small portion of the substrate being imaged safely approximates a "rigid body" for the purposes of the image displacement sensing algorithm being applied within the required precision and/or spatial resolution. In one embodiment, the windows W1 and W2 have linear dimensions that are less than about one percent of the overall dimension of the print media 116, although the scope of the present teachings is not so limited.

The first printhead bank 118 applies an ink pattern onto the print media area 400 in accordance with instructions received from the print operations module 206 at step 608. In another embodiment, step 606 and step 608 are performed at roughly the same time. In another embodiment, step 606 is performed immediately after step 608. At step 610, the print media transport assembly 110 positions the print media 116 at a second position relative to the printing assembly 104 such that the ejection of ink from the second printhead bank 120 creates an ink pattern onto the print media area 400.

Figure 8:
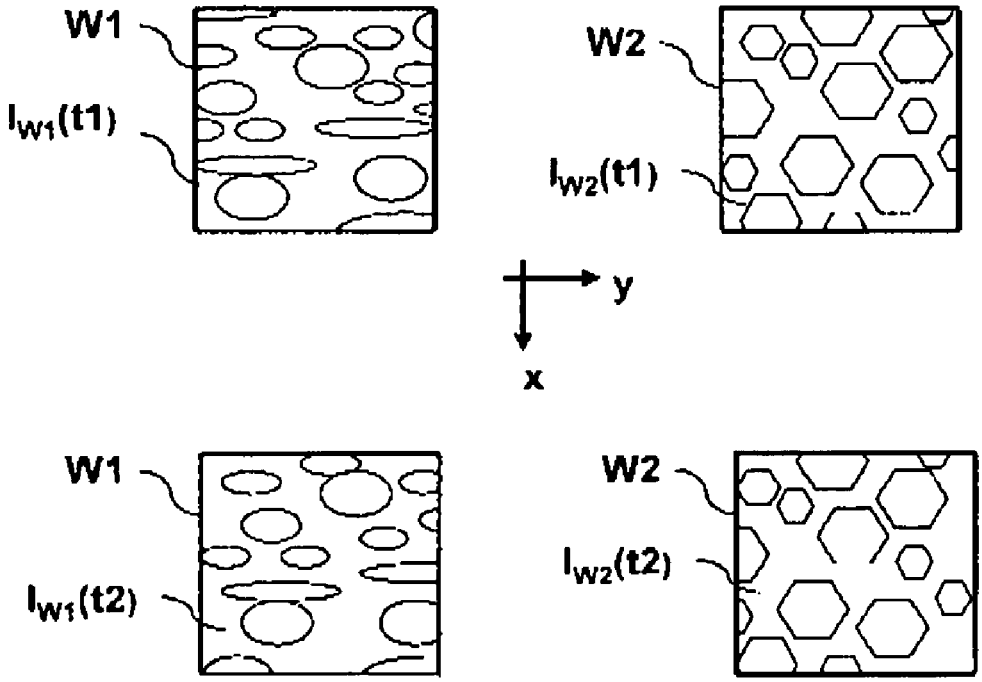
FIG. 8 illustrates the example reference images of FIG. 7 alongside an example of comparison images acquired by the image acquisition system at a second time subsequent to the dimensional changes of the print media.
Figure 9:
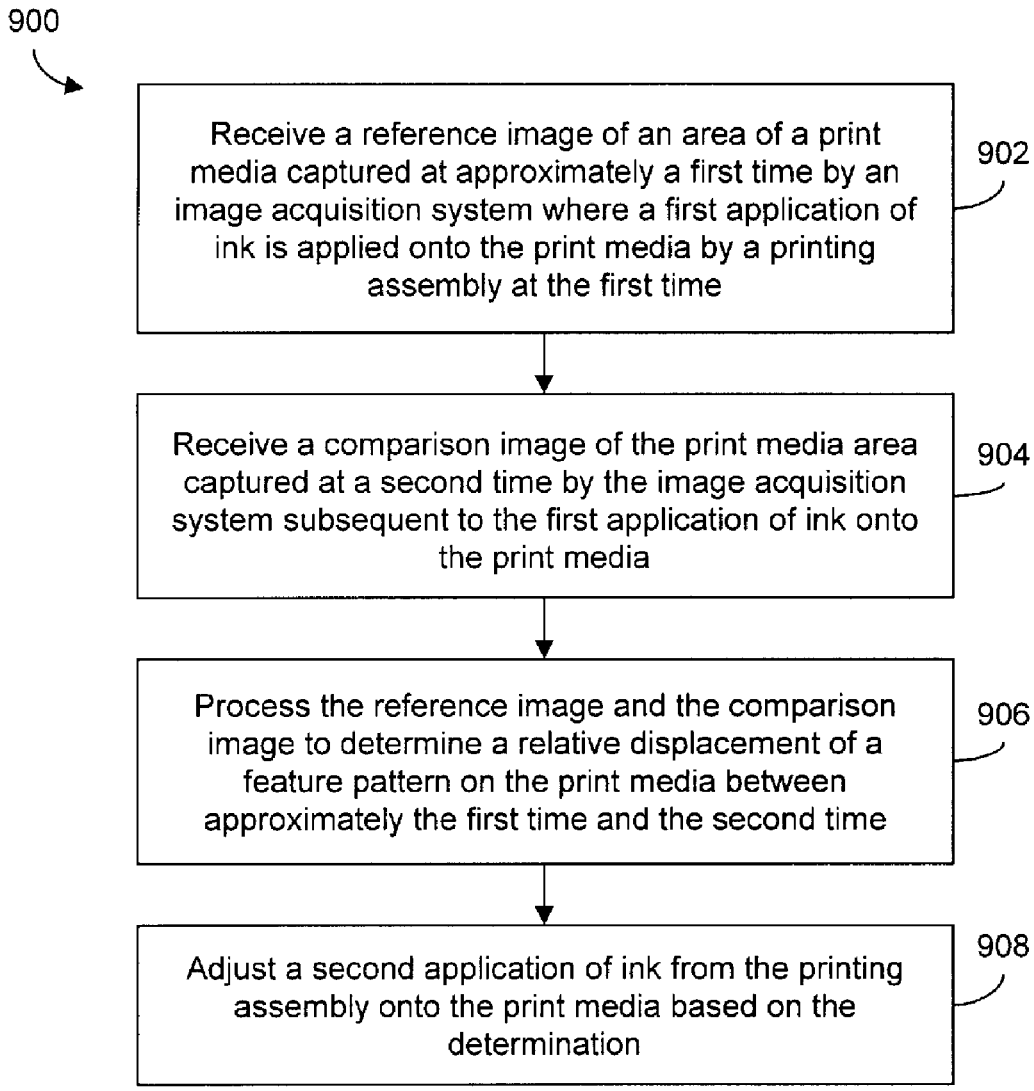
FIG. 9 is a flowchart representation of another embodiment of a method of compensating for print media distortion.

At step 612, the second camera cluster 302*b* captures a set of one or more comparison images of the print media area 400 at the second time t2. The set of one or more comparison images are captured following the occurrence of the dimensional changes of the print media 116 resulting from the application of ink onto the print media area 400 by the first printhead bank 118 but prior to the application of ink from the second printbank 120 onto the print media area 400. Referring to FIG. 8 an illustration of the example reference images $I_{W1}$(t1), $I_{W2}$(t1) of FIG. 7 alongside example comparison images $I_{W1}$(t2), $I_{W2}$(t2) acquired by the image acquisition system 112 at a second time t2 subsequent to the dimensional changes of the print media 116 is shown. A first comparison image $I_{W1}$(t2) is captured in the first window W1 at time t2, and a second comparison image $I_{W2}$(t2) is captured in the second window W2 at time t2. The first and second comparison images $I_{W1}$(t2), $I_{W2}$(t2) are captured by the first and second cameras, respectively, in the second camera cluster 302*b*. In one embodiment, the first and second comparison images $I_{W1}$(t2), $I_{W2}$(t2) within the first and second windows W1, W1 define first and second comparison feature patterns, respectively. In one embodiment, the sub-areas of the first and second comparison images $I_{W1}$(t2), $I_{W2}$(t2) within the first and second windows W1, W1 define first and second comparison feature patterns, respectively.

At step 614, the distortion compensation module 102 processes the reference images $I_{W1}$(t1), $I_{W2}$(t1) and the comparison images $I_{W1}$(t2), $I_{W2}$(t2) to determine the relative displacement of feature patterns in the print media area 400. The distortion compensation module 102 processes the first and second reference images $I_{W1}$(t1), $I_{W2}$(t1) and corresponding comparison images $I_{W1}$(t2), $I_{W2}$(t2) to select first and second feature patterns, respectively. In one embodiment, the feature pattern is a native print media feature pattern. In one embodiment, the feature pattern is a printed feature pattern. In one embodiment, the feature pattern is a combination feature pattern of a native print media feature and a printed feature.

In alternative embodiments, other images may be acquired between times t1 and t2. For example, a sequence of images $I_{W1}$(tn) may be captured in the first window W1, while a sequence of images $I_{W2}$(tn) may be captured in the second window W2. In such cases, the selection of images to be processed by the distortion compensation module 102 may be accomplished through judicial selection of appropriate images from each sequence $I_{W1}$(tn) and $I_{W2}$(tn).

The distortion compensation module 102 processes the first reference image $I_{W1}$(t1) and the first comparison image $I_{W1}$(t2) to determine the relative displacement of the first feature pattern in the print media area 400 between the first time t1 and the second time t2. The distortion compensation module 102 processes the second reference image $I_{W2}$(t1) and the second comparison image $I_{W2}$(t2) to determine the relative displacement of the second feature pattern in the print media area 400 between the first time t1 and the second time t2. The first time t1 is prior to occurrence of the distortion associated with the application of ink onto the print media 116 by the first printhead bank 118. The second time t2 is prior to the application of ink onto the print media 116 by the second printhead bank 120. The displacement of the feature patterns generally results from dimensional changes of the print media 116 resulting from the application of ink by the first printhead bank 118.

According to one embodiment, for each of the windows W1 and W2, a local shift in the print media 116 between times t1 and t2 relative to that window is computed according to an image displacement sensing algorithm.

Image displacement sensing algorithm refers to a class of processing algorithms in which a first matrix $L_t(x,y)$ and a second matrix $L_{t+\Delta t}(x,y)$ are processed to compute a displacement vector $\Delta L$ therebetween under a rigid body assumption, i.e., under an assumption that features or textures of the underlying item within any one window W1 or W2 do not change over the interval $\Delta t$. In one embodiment, image displacement sensing algorithm refers to a subclass of image flow algorithms specially adapted for fast computation under the rigid body assumption. In another embodiment, image displacement sensing algorithm refers to a subclass of image flow algorithms specially adapted for detection of rigid-body displacements to sub-pixel resolutions. In still another embodiment, image displacement sensing algorithm refers to a subclass of image flow algorithms specially adapted to achieve both fast computation and sub-pixel resolution under the rigid body assumption.

In one embodiment, the image displacement sensing algorithm computes a displacement vector $\Delta L$ even in cases where the rigid body assumption does not hold. In such cases, errors may result, the values of the errors being below maximum allowable limits as derived from the specifics of the application.

In accordance with an embodiment, it has been found that one particularly useful image displacement algorithm cross-correlates the first and second matrices to produce a cross-correlation function, and then locates a global extremum of the cross-correlation function. Preferably, the cross-correlating further comprises estimating a continuous correlation surface at sub-pixel locations. A comparison function is computed comprising, for a predetermined number N of relative offset locations (N=9, 25, for example), a sum of squared differences, or other comparison metric, between the elements of the first and second matrices. A cost function is minimized between the comparison function and an estimated continuous correlation surface, wherein the estimated continuous correlation surface is a fitting function whose parameters are varied to minimize the cost function. In one embodiment, the fitting function is equivalent to a truncated Taylor series, although the scope of the present teachings is not so limited. In one embodiment in which the number of offset locations N is 9, the fitting function has six parameters, although the scope of the present teachings is not so limited. A global extremum of the estimated continuous correlation surface is located to determine the displacement, whereby the displacement can be determined to a sub-pixel resolution. Discussions of comparable methods used for optically-acquired images can be found in U.S. Pat. Nos. 5,149,180 and 6,195,475. In accordance with another embodiment, it has been found that another particularly useful image displacement algorithm computes phase differences between frequency domain representations of the first and second matrices, and determines image displacement based on the computed phase differences.

In other embodiments, image displacement sensing algorithms can be used comprising at least one of a differential image flow algorithm, a tensor-based image flow algorithm, a correlation-based image flow algorithm, a phase-shift-based image flow algorithm, and an error analysis-based algorithm, each adapted for rigid-body flow. The outputs of the image displacement sensing algorithms for windows W1 and W2 are the shift vectors Δp1 and Δp2 that, as illustrated in FIG. 8, indicate how far the surface has shifted beneath each respective window between times t1 and t2.

At step 616, the distortion compensation module 102 uses the outputs of the image displacement sensing algorithm to characterize the dimensional change of the print media 116 that has occurred between the first time t1 and the second time t2. The print media 116 undergoes an affine distortion during the distortion interval where the distortion interval is defined as the approximate time period ranging from approximately the first time t1 and approximately the second time t2.

Mathematically, an affine transformation or affine distortion can be characterized as a linear combination of translations, stretches, shrinks, reflections, or rotations, with collinearity being preserved (i.e., straight lines map into straight lines) and concurrency being preserved (i.e., intersecting lines map into intersecting lines). For an arbitrary point p(t1) $=[x(t1),y(t1)]^T$ on a surface of the print media 116 at time t1, that point migrates to a new position p(t2)$=[x(t2),y(t2)]^T$ on the surface of print media 116 at time t2 according to Eqs. (1)-(3) below.

$$\begin{bmatrix} x(t2) \\ y(t2) \end{bmatrix} = M \begin{bmatrix} x(t1) \\ y(t1) \end{bmatrix} + D \quad \{1\}$$

$$M = \begin{bmatrix} a & b \\ c & d \end{bmatrix} \quad \{2\}$$

$$D = \begin{bmatrix} e \\ f \end{bmatrix} \quad \{3\}$$

For any particular affine distortion occurring between t1 and t2, the terms a, b, c, d, e, and f in Eqs. (1)-(3), are scalar parameters that characterize the affine distortion. The matrix M is referred to herein as a shaping matrix, while the vector D is referred to herein as a translation vector. Upon determination of the shaping matrix M and the translation vector D characterizing the dimensional change, the migration of any point on the surface of the print media 116 between time t1 and t2 can be readily computed.

Generally speaking, the types of expansions, contractions, and shears commonly experienced by a typical substrate do not require six different parameters to be sufficiently characterized. For example, thermal expansions and contractions typically would not involve reflections or rotations. Accordingly, the dimensional change of the print media 116 can usually be characterized with fewer than six independently-determined parameters, although the scope of the present teachings indeed extends to six-parameter scenarios. By way of example, if the print media 116 undergoes a shearless, laterally isotropic expansion and is known to have a fixed center position relative to the frame of reference, then the shaping matrix M and the translation vector D are given by Eqs. (4)-(5) below, where s is a scalar expansion factor.

$$M = \begin{bmatrix} s & 0 \\ 0 & s \end{bmatrix} \quad \{4\}$$

$$D = \begin{bmatrix} 0 \\ 0 \end{bmatrix} \quad \{5\}$$

Accordingly, in the example of a shearless laterally isotropic expansion with fixed center position, the dimensional change can be fully characterized by the single parameter s. By way of further example, if the substrate undergoes a shearless anisotropic expansion around an unknown center point relative to the frame of reference, then the shaping matrix M and the translation vector D are given by Eqs. (6)-(7) below, where s1 and s2 are scalar directional expansion factors, and e and f are translations in the x and y directions, respectively.

$$M = \begin{bmatrix} s1 & 0 \\ 0 & s2 \end{bmatrix} \quad \{4\}$$

$$D = \begin{bmatrix} e \\ f \end{bmatrix} \quad \{5\}$$

Accordingly, in the example of a shearless laterally anisotropic expansion with unknown center position, the dimensional change can be characterized by four parameters. For more complex distortions involving shear, one or both of the additional parameters b and c of the shaping matrix M (see Eq. (2), supra) would additionally require computation for characterizing the dimensional change.

As mentioned previously, upon the determination of the shaping matrix M and the translation vector D characterizing the dimensional change of the print media 116 during the distortion interval, the migration of any point on the surface of the print media 116 between the first time t1 and the second time t2 can be readily computed. At step 618, the distortion compensation module 102 uses the determined shaping matrix M and translation vector D to determine the effect of the distortion of the print media 116 in the print media area 400 resulting from the application of ink by the first printhead bank 118. The print operations module 206 adjusts the application of ink from the second printing bank 120 onto the print media 116 accordingly to minimize misalignments between the ink pattern applied by the first printhead bank 118 during the previous printing pass and the ink pattern applied by the second printhead bank 120 during the current printing pass.

While the steps in the method 600 have been described in a particular order, the steps may be performed in a different order, a subset of the described steps, or additional steps may be performed in addition to the described steps.

Referring to FIG. 7, one embodiment of a method 700 of compensating for print media distortion is shown. At step 702, a reference image of an area of a print media 116 captured at approximately a first time t1 by an image acquisition system 112 is received, where a first application of ink is applied onto the print media area 400 by a printing assembly 104 at the first time t1. A comparison image of the print media area 400 captured at a second time t2 by the image acquisition system 112 subsequent to the first application of ink onto the print media area 400 is received at step 704. The reference image and the comparison image are processed to determine a relative displacement of a feature pattern on the print media 116 between approximately the first time t1 and the second time t2 at step 706. A second application of ink from the printing assembly 104 onto the print media 116 is adjusted based on the determination at step 708. While the steps in the method 700 have been described in a particular order, the steps may be performed in a different order or additional steps may be performed in addition to the described steps.

In one embodiment, a printer system provides print media distortion compensation. The printer system includes a printing assembly 104, an image acquisition system 112, a distortion compensation module 102, and a print operations module 206. The image acquisition system 112 is operable to capture a reference image of a print media area 400 at approximately a first time t1 where a first application of ink is applied to the print media 116 at the first time t1 and to capture a comparison image of the print media area 400 at a second time t2 subsequent to the first application of ink onto the print media area 400 by the printing assembly 104. The distortion compensation module 102 is operable to process the reference image and the comparison image to determine a relative displacement of a feature pattern on the print media 116 between approximately the first time t1 and the second time t2. The print operations module 206 is operable to issue a command to adjust a second application of ink by the printing assembly 104 onto the print media 116 based on the determination.

In one embodiment, a computer readable medium stores a computer executable program for providing print media distortion compensation. The computer readable medium includes computer readable code for receiving a reference image of an area of a print media captured at approximately a first time by an image acquisition system, wherein a first application of ink is applied onto the print media area by a printing assembly at the first time, computer readable code for receiving a comparison image of the print media area captured at a second time by the image acquisition system subsequent to the first application of ink onto the print media area, computer readable code for processing the reference image and the comparison image to determine a relative displacement of a feature pattern on the print media between approximately the first time and the second time, and computer readable code for adjusting a second application of ink from the printing assembly onto the print media based on the determination.

It should be noted that while systems implemented using software or firmware executed by hardware have been described above, those having ordinary skill in the art will readily recognize that the disclosed systems could be implemented exclusively in hardware through the use of one or more custom circuits, such as for example, application-specific integrated circuits (ASICs) or any other suitable combination of hardware and/or software.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

The invention claimed is:

1. A printer system operable to provide print media distortion compensation, the printer system comprising:

a printing assembly;

an image acquisition system operable to capture a reference image of a print media area at approximately a first time where a first application of ink is applied to the print media at the first time and to capture a comparison image of the print media area at a second time subsequent to the first application of ink onto the print media area by the printing assembly;

a distortion compensation module operable to process the reference image and the comparison image to determine a relative displacement of a feature pattern on the print media between approximately the first time and the second time; and a print operations module operable to issue a command to adjust a second application of ink by the printing assembly onto the print media based on the determination.

2. The printer system of claim 1, wherein the printing assembly comprises a plurality of printhead banks and the image acquisition system comprises a plurality of camera clusters, each one of the plurality of camera clusters being coupled to a corresponding one of the plurality of printhead banks such that each camera cluster is operable to capture at least one image of an area of print media positioned to receive an application of ink from the associated printhead bank.

3. The printer system of claim 1, wherein approximately the first time is selected from a group consisting of a time preceding the first application of ink onto the print media area, a time simultaneous with the first application of ink onto the print media area, and a time immediately after the first application of ink onto the print media area.

4. The printer system of claim 1, wherein the distortion compensation module is operable to process the reference image and the comparison image to select the feature pattern from a group consisting of a native print media feature pattern, a printed feature pattern, and a combination feature pattern of a native print media feature and a printed feature.

5. The printer system of claim 1, wherein the distortion compensation system is operable to process the reference image and the comparison image using an image displacement sensing algorithm to determine the relative displacement of the feature pattern on the print media.

6. The printer system of claim 5, wherein the distortion compensation module is operable to process the determined relative displacement of the feature pattern to characterize a dimensional change of the print media between approximately the first time and the second time.

7. The printer system of claim 1, wherein the command issued by the print operations module to adjust the second application of ink by the printing assembly onto the print media is selected from a group consisting of an adjusting a timing of firing of a printhead of the printing assembly command, an adjusting a timing of firing of a nozzle of the printing assembly command, an adjusting a selection of printheads of the printing assembly command, an adjusting a selection of nozzles of the printing assembly command, and an adjusting a position of a printhead of the printing assembly command.

8. The printer system of claim 1, wherein the second time is subsequent to a dimensional change of the print media resulting from the first application of ink.

9. A method of compensating for print media distortion, the method comprising:

receiving a reference image of an area of a print media captured at approximately a first time by an image acquisition system, wherein a first application of ink is applied onto the print media area by a printing assembly at the first time;

receiving a comparison image of the print media area captured at a second time by the image acquisition system subsequent to the first application of ink onto the print media area;

processing the reference image and the comparison image to determine a relative displacement of a feature pattern on the print media between approximately the first time and the second time; and adjusting a second application of ink from the printing assembly onto the print media based on the determination.

10. The method of claim 9, wherein the printing assembly comprises a plurality of printhead banks and the image acquisition system comprises a plurality of camera clusters, each one of the plurality of camera clusters being coupled to a corresponding one of the plurality of printhead banks such that each camera cluster is operable to capture at least one image of an area of print media positioned to receive an application of ink from the associated printhead bank.

11. The method of claim 9, wherein receiving a reference image of an area of a print media captured at approximately a first time comprises receiving a reference image of the area of the print media captured at approximately a first time selected from a group consisting of a time preceding the first application of ink onto the print media area, a time simultaneous with the first application of ink onto the print media area, and a time immediately after the first application of ink onto the print media area.

12. The method of claim 9, wherein processing the reference image and the comparison image to determine a relative displacement of a feature pattern on the print media comprises selecting the feature pattern from a group consisting of a native print media feature pattern, a printed feature pattern, and a combination feature pattern of a native print media feature and a printed feature.

13. The method of claim 9, wherein processing the reference image and the comparison image to determine a relative displacement of a feature pattern on the print media comprises processing the reference image and the comparison image using an image displacement sensing algorithm to determine the relative displacement of the feature pattern on the print media.

14. The method of claim 13, further comprising processing the determined relative displacement of the feature pattern to characterize a dimensional change of the print media between approximately the first time and the second time.

15. The method of claim 9, wherein adjusting a second application of ink from the printing assembly onto the print media comprises issuing a command selected from a group consisting of an adjusting a timing of firing of a printhead of the printing assembly command, an adjusting a timing of firing of a nozzle of the printing assembly command, an adjusting a selection of printheads of the printing assembly command, an adjusting a selection of nozzles of the printing assembly command, and an adjusting a position of a printhead of the printing assembly command.

16. The method of claim 9, wherein the second time is subsequent to a dimensional change in the print media resulting from the first application of ink.

17. A non-transitory computer readable medium storing a computer executable program for providing print media distortion compensation, the computer readable medium comprising:

computer readable code for receiving a reference image of an area of a print media captured at approximately a first time by an image acquisition system, wherein a first application of ink is applied onto the print media area by a printing assembly at the first time;

computer readable code for receiving a comparison image of the print media area captured at a second time by the image acquisition system subsequent to the first application of ink onto the print media area;

computer readable code for processing the reference image and the comparison image to determine a relative displacement of a feature pattern on the print media between approximately the first time and the second time; and computer readable code for adjusting a second application of ink from the printing assembly onto the print media based on the determination.

18. The non-transitory computer readable medium of claim 17, wherein the computer readable code for receiving a reference image of an area of a print media captured at approximately a first time comprises receiving a reference image of the area of the print media captured at approximately a first time selected from a group consisting of a time preceding the first application of ink onto the print media area, a time simultaneous with the first application of ink onto the print media area, and a time immediately after the first application of ink onto the print media area.

19. The non-transitory computer readable medium of claim 17, wherein the computer readable code for processing the reference image and the comparison image to determine a relative displacement of a feature pattern on the print media comprises selecting the feature pattern from a group consisting of a native print media feature pattern, a printed feature pattern, and a combination feature pattern of a native print media feature and a printed feature.

20. The non-transitory computer readable medium of claim 17, wherein the computer readable code for processing the reference image and the comparison image to determine a relative displacement of a feature pattern on the print media comprises processing the reference image and the comparison image using an image displacement sensing algorithm to determine the relative displacement of the feature pattern on the print media.

21. The non-transitory computer readable medium of claim 20, further comprising computer readable code for processing the determined relative displacement of the feature pattern to characterize a dimensional change of the print media between approximately the first time and the second time.

22. The non-transitory computer readable medium of claim 17, wherein the computer readable code for adjusting a second application of ink from the printing assembly onto the print media based on the determination comprises computer readable code for issuing a command selected from a group consisting of an adjusting a timing of firing of a printhead of the printing assembly command, an adjusting a timing of firing of a nozzle of the printing assembly command, an adjusting a selection of printheads of the printing assembly command, an adjusting a selection of nozzles of the printing assembly command, and an adjusting a position of a printhead of the printing assembly command.

23. The non-transitory computer readable medium of claim 17, wherein the second time is subsequent to a dimensional change in the print media resulting from the first application of ink.

* * * * *